US005253874A

United States Patent [19]

Hoffman

[11] Patent Number: 5,253,874

[45] Date of Patent: Oct. 19, 1993

[54] ADHESIVE FILAMENT AND MEMBRANE RACQUET

[75] Inventor: Donald L. Hoffman, Wynnewood, Pa.

[73] Assignee: Hilco Corporation, Norristown, Pa.

[21] Appl. No.: 930,884

[22] Filed: Aug. 14, 1992

[51] Int. Cl.[5] ..... A63B 59/00; A63B 67/00

[52] U.S. Cl. ..... 273/346; 273/67 R; 273/412; 273/DIG. 30

[58] Field of Search ..... 273/327, 346, 412, 67 R, 273/67 B, DIG. 30

[56] References Cited

U.S. PATENT DOCUMENTS

| | | | |
|---|---|---|---|
| 4,131,278 | 12/1978 | Goldenberg | 273/67 R |
| 4,735,420 | 4/1988 | Seidler | 273/412 |
| 4,789,161 | 12/1988 | Waskelo | 273/327 |
| 4,995,617 | 2/1991 | Lee | 273/346 |
| 5,080,374 | 1/1992 | Yu | 273/346 |
| 5,160,147 | 11/1992 | Ping | 273/346 |
| 5,165,684 | 11/1992 | Pratt | 273/67 B |
| 5,188,359 | 2/1993 | Wu | 273/67 R |

FOREIGN PATENT DOCUMENTS

| | | | |
|---|---|---|---|
| 3321343 | 12/1984 | Fed. Rep. of Germany | 273/346 |

*Primary Examiner*—William H. Grieb

*Attorney, Agent, or Firm*—Sediel, Gonda, Lavorgna & Monaco

[57] ABSTRACT

A racquet intended to be used to propel and catch a VELCRO-covered ball for recreational sports. The racquet includes a rim surrounding a convex plate, the outer surface of the plate being a catching surface covered with a pad of adhesive filament material (VELCRO). A latex membrane is stretched across the rim over the inner concave surface of the plate to define a hollow drum chamber into which the latex membrane may flex when a ball is struck. The membrane acts as a resilient striking surface, and vibrates over the drum chamber to produce a loud sound wave when the ball is struck.

5 Claims, 2 Drawing Sheets

ADHESIVE FILAMENT AND MEMBRANE RACQUET

TECHNICAL FIELD

This invention is related to the general field of sporting goods and games; and is particularly related to games in which contestants propel a ball to each other by striking it with a racquet.

BACKGROUND ART

Since the common availability of fabrics faced with adhesive filaments, particularly the hook and pile mating materials manufactured under the trademark VELCRO®, there have been several game devices which take advantage of the adhesive filament material's ability to arrest and hold a projectile having a surface made of suitable mating material.

For example, U.S. Pat. No. 5,080,374 (Yu) discloses a VELCRO® covered ball and a racquet with VELCRO® covering a cushioned face of the racquet head. The ball may be propelled by striking it with the bare solid face of the racquet, or caught by arresting the ball against the cushioned VELCRO® face, whereby the interlocking hooks of the VELCRO® material hold the ball to the racquet.

U.S. Pat. No. 4,789,161 discloses a toss and catch game using a cushioned bat covered by material having one filament of a mating filament pair and having a flexible handle, to catch and throw a ball covered with the other filament of the mating pair. The flexible handle and bat length are apparently necessary to develop enough bat speed to part the mating materials and propel the ball when the player suddenly stops the bat.

U.S. Pat. No. 4,995,617 (Lee) discloses a catching mitt having a concave rigid frame with a cushioning material covered by VELCRO® as its pocket. The back side has a strap for holding the mitt on a player's hand. The game is played like throwing and catching a baseball, except that the player need not trap the ball in the center of the pocket or squeeze the mitt to trap the ball, since the VELCRO® covered ball will stick to the mitt if it touches any substantial portion of the VELCRO cushioning material. It is thus suited for small children. Adults playing the game are limited to the velocity and distance at they can throw a light ball.

German publication DE 3321343 Al discloses a plastic disc hiving an adhesive fabric on one surface to catch a ball covered with a mating fabric. The disc can have a handle in back or a handle like a tennis racquet, and is used to catch the ball similar to the use of the catchers mitt described above. It does not describe using the disc to propel the ball.

A relatively lightweight ball, such as a tennis ball or its equivalent, is difficult to throw with great speed or for great distance. Hence, participants using a bat or disc solely as a catching device will be limited to throw and catch type games. To create faster paced, more athletically challenging games which take advantage of adhesive filament material's ability to arrest and hold a projectile made of suitable mating material, it is necessary to increase the ball speed and distance of flight. One way to increase the ball speed and distances is to strike the ball with a rigid hand-paddle or racquet. This is essentially the advantage created by racquet and ball combination of U.S. Pat. No. 5,080,374, described above.

However, a solid-faced or rigid racquet requires that the ball be struck near the center, or "sweet spot" of the racquet face, for a smooth impact. If the ball is struck near the perimeter of the face, a jarring moment is transmitted along the handle into the wrist and elbow of the player. If the player is not strong enough to resist this moment, the racquet may twist and return the ball off-line. Prolonged use may cause wrist or elbow inflammation, particularity in young children.

It is known that resilient or flexible striking surfaces tend to alleviate this problem. For example, wooden-frame and more loosely-strung tennis racquets are known to transmit less twisting moment from an off-center hit than a metal-framed tightly-strung racquet.

However, with the prior art racquets and mitts described above for use with VELCRO®-covered balls and catching surfaces, it has been customary to make the catching surface resilient, not the striking surface. Hence, one object of the invention is to provide a racquet with a resilient striking surface.

Another object of the invention is to increase the noise produced by the impact of the racquet against the ball. Games of this type are popular on beaches and around swimming pools, where the ability to attract the attention of spectators and by-passers is at least as valued as any perceived aerobic or recreational value of the sport.

These objectives are accomplished by the following racquet.

SUMMARY DISCLOSURE OF THE INVENTION

A racquet has a rim surrounding a convex plate. The outer convex surface of the plate is a catching surface covered with a pad of adhesive filament material (VELCRO®). A resilient latex membrane is stretched across the rim over the inner concave surface of the plate to define a hollow drum chamber into which the latex membrane may flex when a ball is struck. The membrane and inner surface of the plate act as a resilient striking surface to cushion the impact and reduce the twisting moment from off-center strikes. The membrane vibrating over the drum chamber produces a loud sound wave. The racquet is intended to be used to propel and catch a VELCRO®-covered tennis ball.

In a preferred embodiment, the filament material and latex membrane are attached to the rim by detachable rings which interlock to the rim, allowing easy assembly.

BRIEF DESCRIPTION OF THE DRAWINGS

For the purpose of illustrating the invention, the drawings show a form which is presently preferred; it being understood, however, that this invention is not limited to the precise arrangements and instrumentalities shown.

BEST MODE FOR CARRYING OUT THE INVENTION

Figure 1:
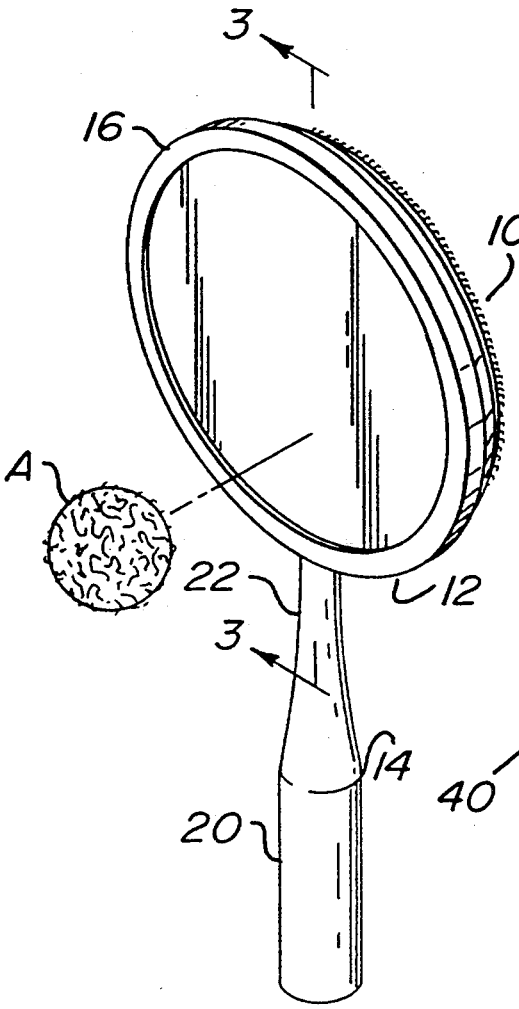
FIG. 1 is an oblique prospective view of a racquet according to the present invention, in a direction obliquely facing the latex membrane striking surface.

As shown in the drawings, the racquet (10) is assembled around a frame (12) which includes a handle (14), generally circular rim (16) and convex plate (18). In the currently preferred embodiment, the frame is integrally molded plastic material, with the rim being a true circle having approximately eight-inch diameter and the handle being eight to ten inches long. The handle includes a bottom grip portion (20) changing to a tapered throat (22), as shown in FIG. 1. Although the rim in the depicted embodiment is a true circle, the term "generally circular" as used herein will be understood to include ovals of the type commonly used in raquets.

The plate (18) has an outer convex face (24) and an inner concave face (26). A catch pad (28) is stretched over and glued to the outer convex face. The pad (28) comprises a circular patch of nylon fabric covered by a circular patch of VELCRO® material. If additional cushioning is desired, a slightly smaller diameter circular piece of flexible polyurethane foam may be sandwiched between the nylon and the VELCRO®. A locking rim (30) having an inside diameter essentially the same as the outside diameter of the frame's circular rim (16) is glued and then press-fit over the frame rim (16). A short flange (32) of the locking rim extends from the rim at an angle essentially tangent to the convex arc of the plate, thereby conforming closely along the circumference of the catch pad to protect the edge of the VELCRO.

A thin latex membrane (34) is glued to a circular support frame (36). The frame and attached membrane are then inserted into the frame rim (16). The frame has a flange portion (38) between the rim (16) and the plate (18), against which the membrane support frame rests. Another locking rim (40) having an inside diameter essentially the same as the outside diameter of the first locking rim (30) is glued and then press-fit over the first locking rim (30) and frame rim (16). A short flange (42) of the locking rim (40) extends inwardly perpendicular to the rim, thereby conforming closely along the circumference of the latex membrane to protect the edge of the membrane.

The locking rims (30, 40) each have a bottom notch to fit around the handle.

Figure 3:
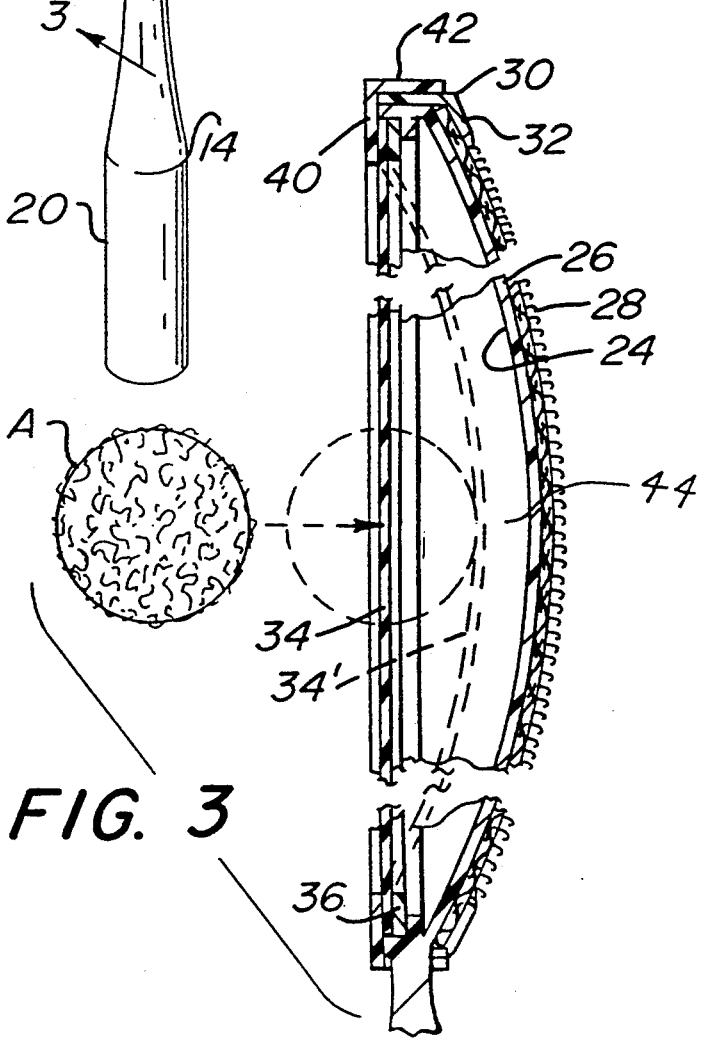
FIG. 3 is a section of the racquet of FIG. 1 along the line 3—3 and in the direction of the arrows 3—3.
Figure 2:
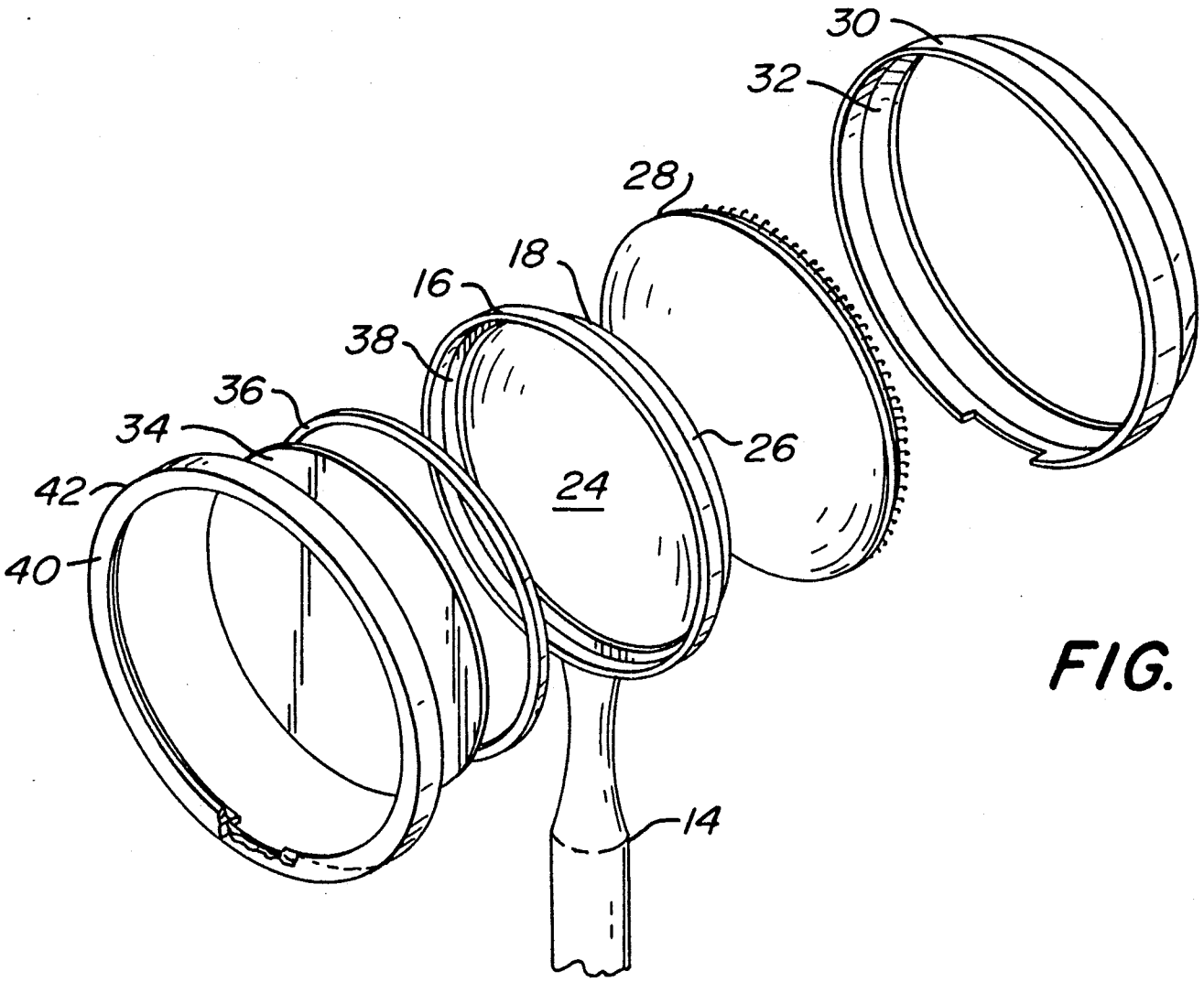
FIG. 2 is an exploded view of the head of the racquet of FIG. 1, illustrating the components of the head and their relationship to each other.

In the static position shown in FIG. 3, the latex membrane and inner concave face (26) define between them a sealed drum chamber (44). When a ball (A) is struck, the latex membrane stretches into the chamber as shown by the ghost-line depiction of the membrane (34') in FIG. 3. This provides a cushioning effect to the impact reaction transmitted back through the player's hand, but unlike soft cushioning, the latex quickly rebounds to return energy to propel the ball. The latex further reduces the torque moment of an off-center strike.

In addition, the flexing and rebounding membrane creates a sound wave which is perceived by human ears as a loud noise associated with a powerful impact, thus exaggerating the apparent prowess of the players.

The racquet is intended to be used with a VELCRO®-covered tennis ball (A). As described in the background of the invention, the hooked filaments of the ball will engage the similar filaments of the VELCRO®-covered catching pad material's ability to arrest and hold a projectile having a surface made of suitable mating material since the tuft of a tennis ball will engage the hooked VELCRO® of the catching pad (28). In previous devices of this type, if the catch pad was not flat, it was traditionally formed as a concave surface similar to the pocket in a catcher's mitt. However, since the ball is arrested and held by the hooked-material filaments rather than a trap-and-squeeze movement used in catching a baseball, the traditional concave catching surface is an unnecessary carry-over from the suppositions of prior devices. The present invention has a concave catching surf ace due to the shape of the plate (18) and the desire to create the drum chamber (44), yet the VELCRO®-covered balls readily adhere to the concave catching pad (28).

INDUSTRIAL APPLICABILITY

The described invention is a recreational item likely to be used at beaches, picnic areas or lawns for recreation and exercise.

The present invention may be embodied in other specific forms without departing from the spirit or essential attributes thereof and, accordingly, reference should be made to the appended claims, rather than to the foregoing specification, as indicating the scope of the invention.

I claim:

1. A racquet for striking and catching a ball of the type which is covered with a an adhesive filament material which will adhere to a structure covered with a similar adhesive filament material, the racquet comprising:

a frame which includes a handle and a rim;

a striking face comprising a membrane of resilient material stretched across one side of said rim;

support frame means having a flat surface for adhering the membrane to the flat surface;

means for securing the support frame means and membrane adhered thereto to said frame, the means for securing having a flange for covering the outer edge of the membrane;

a convex catching plate attached to said rim and extending in a convex arc in the direction opposite the striking face;

said membrane, catching plate and rim defining between them a sealed drum chamber; and the convex surface of the catching plate being covered with an outer layer of said adhesive filament material.

2. A racquet as in claim 1, wherein the frame is an integral piece which includes the handle, rim, and convex plate.

3. A racquet as in claim 2, wherein the frame is molded from a plastic material.

4. A racquet as in claim 1, wherein the rim is generally circular.

5. A racquet as in claim 1, wherein the membrane is made of a latex material.

* * * * *